US006080448A

United States Patent [19]

Leiner et al.

[11] Patent Number: 6,080,448

[45] Date of Patent: Jun. 27, 2000

[54] DEACIDIFICATION OF CELLULOSE BASED MATERIALS USING HYDROFLUOROETHER CARRIERS

[75] Inventors: Lee H. Leiner, New Kensington; James E. Burd, Saxonburg; Robert M. Gaydos, Export, all of Pa.

[73] Assignee: Preservation Technologies LP, Cranberry Township, Pa.

[21] Appl. No.: 09/054,690

[22] Filed: Apr. 3, 1998

[51] Int. Cl.[7] ..... B05D 5/00

[52] U.S. Cl. ..... 427/427; 427/331; 427/439

[58] Field of Search ..... 427/331, 439, 427/427; 162/160; 422/1

[56] References Cited

U.S. PATENT DOCUMENTS

| | | | |
|---|---|---|---|
| 2,864,723 | 12/1958 | Fluck et al. | 117/76 |
| 3,472,611 | 10/1969 | Langwell | 21/58 |
| 3,536,578 | 10/1970 | Brundige et al. | 162/160 |
| 3,665,041 | 5/1972 | Sianesi et al. | 260/615 A |
| 3,676,055 | 7/1972 | Smith | 8/120 |
| 3,676,182 | 7/1972 | Smith | 117/60 |
| 3,703,353 | 11/1972 | Kusterer, Jr. et al. | 21/58 |
| 3,771,958 | 11/1973 | Kusterer, Jr. et al. | 21/58 |
| 3,810,874 | 5/1974 | Mitsch et al. | 260/75 H |
| 3,898,356 | 8/1975 | Williams et al. | 427/343 |
| 3,939,091 | 2/1976 | Kelly, Jr. | 252/189 |
| 3,969,549 | 7/1976 | Williams et al. | 427/248 |
| 4,051,276 | 9/1977 | Williams et al. | 427/248 C |
| 4,318,963 | 3/1982 | Smith | 428/537 |
| 4,522,843 | 6/1985 | Kundrot | 427/27 |
| 4,523,039 | 6/1985 | Lagow et al. | 568/615 |
| 5,137,760 | 8/1992 | Lundquist | 427/439 |
| 5,208,072 | 5/1993 | Kamienski et al. | 427/296 |
| 5,264,243 | 11/1993 | Wedinger et al. | 427/140 |
| 5,409,736 | 4/1995 | Leiner et al. | 427/372.2 |
| 5,422,147 | 6/1995 | Leiner et al. | 427/600 |
| 5,605,882 | 2/1997 | Klug et al. | 510/411 |
| 5,733,416 | 3/1998 | Kaiser | 203/1 |
| 5,750,797 | 5/1998 | Vitcak et al. | 568/683 |
| 5,770,148 | 6/1998 | Leiner et al. | 422/40 |

FOREIGN PATENT DOCUMENTS

| | | |
|---|---|---|
| 911110 | 10/1972 | Canada . |
| 0 543 372 A1 | 5/1993 | European Pat. Off. . |
| WO 87/00217 | 1/1987 | WIPO . |

OTHER PUBLICATIONS

Database WPI, Section CH, Week 9817, Derwent Publications Ltd., London GB; Class E33, AN 98–189876, XP002106837 & JP 10 046497 A (Kato H), Feb. 17, 1998.

*Primary Examiner*—Shrive Beck
*Assistant Examiner*—Kirsten A. Crockford
*Attorney, Agent, or Firm*—Kirkpatrick & Lockhart LLP

[57] ABSTRACT

An improved method of deacidifying books, imaged paper and other imaged materials having a cellulose base wherein, for a sufficient time to raise the pH of the materials, the materials are treated with alkaline particles of a basic metal oxide, hydroxide or salt dispersed in a hydrofluorether carrier, alone, or in combination with a perfluorinated carrier. A surfactant is added.

17 Claims, 1 Drawing Sheet

DEACIDIFICATION OF CELLULOSE BASED MATERIALS USING HYDROFLUOROETHER CARRIERS

CROSS REFERENCE TO RELATED APPLICATION

Not Appicable

STATEMENT REGARDING FEDERALLY SPONSORED RESEARCH

Not Appicable

REFERENCE TO MICROFICHE APPENDIX

Not Appicable

BACKGROUND OF THE INVENTION

The deterioration of paper, books and newspapers is well-known and of growing concern to librarians and archivists throughout the world. The causes of paper deterioration are numerous and include inherent acidity, photodegradation, oxidation, and even microbiological attack under certain conditions. These factors combined with initial paper quality have severely reduced the permanence of library and archival collections. It is becoming generally accepted that the most insidious problem is the acidity of most book paper produced in the last one hundred years.

The demand for large amounts of printing paper over the last century led to the introduction of pulp fiber produced from wood by chemical or mechanical means. However, paper made from untreated wood pulp is too absorbent to allow sharp image imprint. Therefore, chemicals have to be added to the wood fibers during processing. These additives allow the paper to accept inks and dyes and increase paper opacity. Unfortunately, most of these chemicals are either acidic or are deposited by acidic mechanisms which initiate the slow, but relentless acidic deterioration of paper. Other contributions to the acidification of paper are supplied by man through industrial emissions of sulfur and nitrogen and carbon oxides or by natural processes such as sea salt spray. Even books or paper of neutral and alkaline characters are not immune. As neighboring papers of acidic nature degrade, volatile acids are produced which either diffuse through adjoining books or permeate the atmosphere and may ultimately acidify even the "safe or stable" books.

In order to arrest this acidic degradation, paper materials must be deacidified and provided with an alkaline reserve or buffer to retard a return to an acidic state. There are several known processes for deacidifying paper whether bound or unbound. Numbering among these are processes using volatile metal alkyls, e.g. U.S. Pat. Nos. 3,969,549, and 4,051,276, and volatile amines e.g. U.S. Pat. Nos. 3,472,611, 3,771,958 and 3,703,353. U.S. Pat. No. 3,676,182 describes the treatment of cellulosic materials with alkali and alkaline earth bicarbonates, carbonates, and hydroxides in a halogenated hydrocarbon solvent or lower aliphatic hydrocarbon such as n-butane with an optional plasticizing agent such as ethylene glycol. U.S. Pat. No. 3,676,055 to Smith describes a nonaqueous deacidification solution for treating cellulosic materials comprising 1000 cc of 7 percent magnesium methoxide in methanol and in addition 20 pounds of dichlorodifluoromethane (Freon 22). Canadian Patent No. 911,110 to Smith describes a deacidification solution of a 7% magnesium methoxide solution in methanol (10 parts) and a halogenated solvent or solvents (90 parts): and states that a magnesium alkoxide reacts with water in paper to form a mildly alkaline milk of magnesia, being magnesium hydroxide. Improved results are reported with the use of the halogenated hydrocarbon solvents.

Unfortunately, all of these processes suffer from one or more of a number of drawbacks that have prevented their wide-spread acceptance. These drawbacks include high cost, toxicity, complexity of treatment, residual odor, deleterious effects on certain types of paper and inks, lack of an alkaline reserve, and the necessity of drying the book or paper to very low moisture contents before treatment.

Kundrot, U.S. Pat. No. 4,522,843, provided a solution to the problems experienced with prior art systems. The method of the Kundrot patent utilizes a dispersion of alkaline particles of a basic metal oxide, hydroxide or salt, such as magnesium oxide, in a gas or liquid dispersant. The MgO, when converted to $Mg(OH)_2$, according to the reaction $MgO+H_2O \rightarrow Mg(OH)_2$ effectively neutralizes the initial acidity in the paper and provides an adequate alkaline reserve to counter future re-acidification. The deacidification reactions occur later (a period of days) and are typically described as $Mg(OH)_2+H_2O_4 \rightarrow MgSO_4+2H_2O$. The liquid dispersant or carrier, described in the Kundrot patent is an inert halogenated hydrocarbon. It does not take part in the deacidification, but serves to carry the particles to the fabric of the paper. In several embodiments described, the halogenated hydrocarbons are Freons, or chlorofluorocarbons (CFC). CFC's have since been found to harm public health and the environment by depleting ozone in the upper atmosphere. Manufacturers of CFC's presently place limits on the amounts they will sell to any one purchaser and are phasing out production of CFC's entirely.

A replacement for the CFC carrier in the method of deacidifying books and other cellulose based materials described in the Kundrot patent was described in Leiner et al., U.S. Pat. No. 5,409,736. The Leiner patent replaced the CFC's of the Kundrot patent with perfluorinated carriers, such as perfluoropolyoxy ether and perfluoromorpholine. Unlike CFC's, perfluorocarbons are not known to cause damage to the ozone layer. However, perfluorocarbons are classified as greenhouse gases because they decompose slowly and trap heat in the atmosphere.

SUMMARY OF THE INVENTION

The present invention provides an improvement in a method for deacidifying cellulose based materials, such as books, magazines, newspapers, maps, documents, photographs and postcards, facsimile paper, folders, imaged paper and the like. The method involves generally treating the cellulose based materials with alkaline particles of a basic metal selected from the group consisting of oxides, hydroxide and salts, dispersed in a carrier liquid or similar dispersion medium, in an amount and for a time sufficient to pass the alkaline particles into the interstices of the materials and increase the pH of the materials. The improvement comprises dispersing the alkaline particles in an inert medium comprised of a hydrofluoroether carrier and a surfactant. Optionally, the carrier may include combinations of hydrofluoroether and a perfluorinated compound.

The hydrofluoroether carrier of the present invention does not damage the cellulose based materials by discoloring pages or leather bindings and covers, nor does it cause inks to run or fade or weaken bindings The new carrier has a relatively short lived atmospheric life time, disassociating into components in few years. The new carrier has an ozone depletion potential of zero and is not classified as a greenhouse gas. Therefore, it is ecologically preferable to the CFC's used in the past.

The hydrofluoroether carriers have been found to provide a better dispersion of the alkaline particles with less surfactant than the CFC or the perfluorinated carriers.

DETAILED DESCRIPTION OF THE PREFERRED EMBODIMENTS

Figure 1:
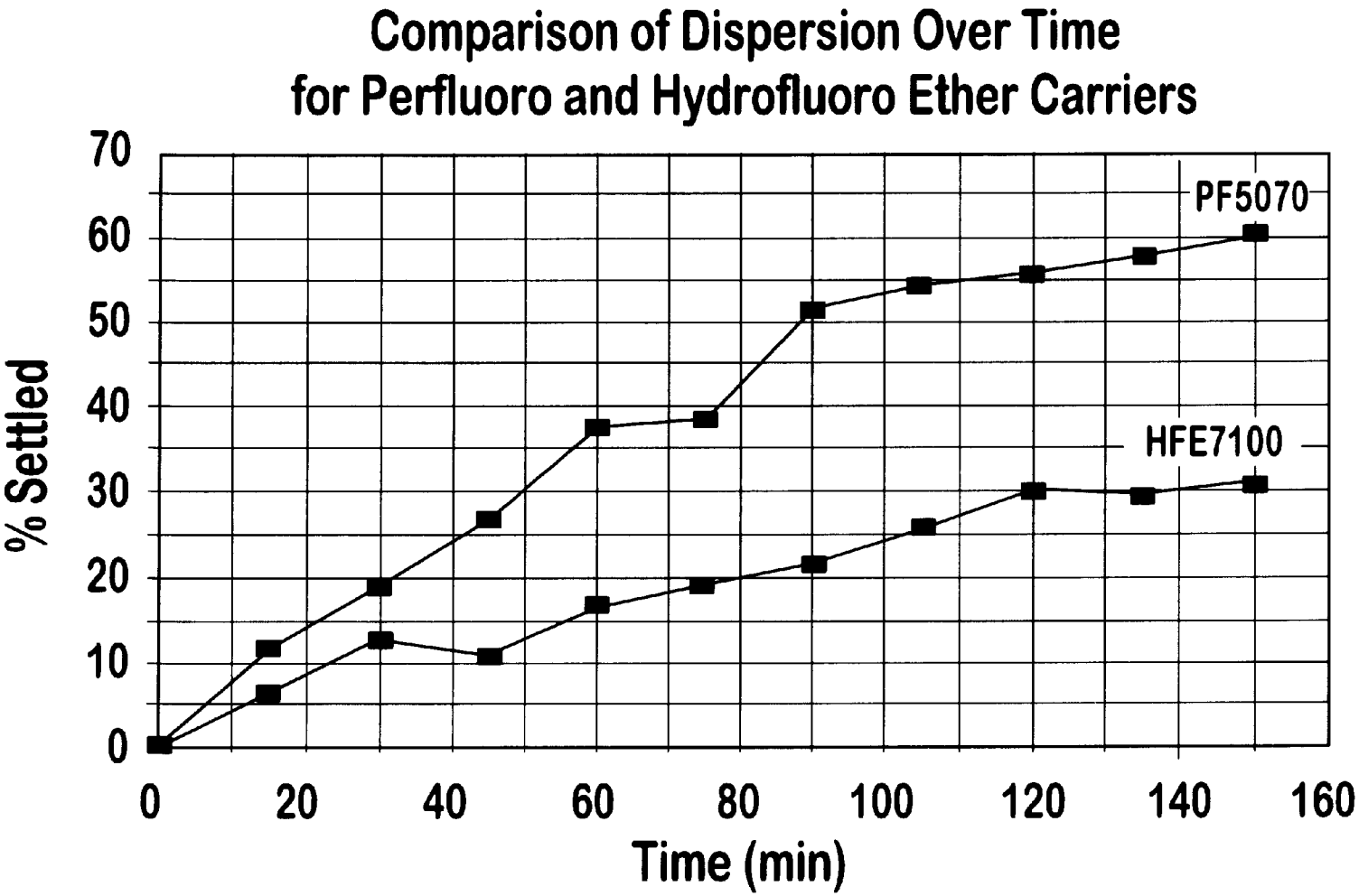
FIG. 1 is a graph showing the comparison between the settling rate for samples of alkaline particles dispersed in hydrofluoroether and that of samples of alkaline particles dispersed in a perfluorinated compound.

The cellulosic materials can be treated with any suitable basic metal oxide, hydroxide or salt as described in U.S. Pat. No. 4,522,843 to Kundrot, which is hereby incorporated herein by reference. Suitable materials, according to the Kundrot patent, are the oxides, hydroxides, carbonates and bicarbonates of the Group I and II metals of the Periodic table and zinc. Preferred are the materials in which the cation is magnesium, zinc, sodium, potassium, or calcium. Particularly preferred are the relatively non-toxic oxides, carbonates and bicarbonates of magnesium and zinc and the hydroxides of sodium, potassium and calcium. Representative examples include magnesium oxide, magnesium carbonate, magnesium bicarbonate, zinc carbonate, zinc bicarbonate, zinc oxide, sodium hydroxide, potassium hydroxide and calcium hydroxide. Magnesium oxide is most preferred. The predominate particle size (95–99%) is preferably between 0.05 and 2.0 micron. Typical surface areas are between 50 and 200 $m^2/g$ BET, preferably about 170–180 $m^2/g$.

The particles can be formed by burning the elemental metal and collecting the smoke, attrition of the preformed oxides or calcination of the elemental salts. For example, basic magnesium carbonate can be calcined at 450° C.–550° C. to produce a polydisperse high activity magnesium oxide with an average particle size of 0.4 microns and a predominant particle size between 0.1 and 1.0 micron. The smaller particles can be filtered out.

The particles can be applied in the paper making process or to the finished paper by immersing the paper in a suspension of the non-aqueous inert deacidifying fluid. Inert as used herein means that there is a very low interaction, and preferably no interaction, between the fluid medium and inks, dyes, bindings, cover materials and the like in the cellulose based materials. The inert fluid medium of the present invention is a hydrofluoroether carrier and a surfactant that will disperse the alkaline particles in the carrier.

Optionally, the carrier may be comprised of a combination of hydrofluoroether and perfluorinated compounds. Hydrofluoroether is miscible in all proportions with perfluorinated compounds so the carriers blend readily. The volatility of the carrier medium can be adjusted by adding varying amounts of perfluorinated compounds to achieve a desired volatility. Perfluorohexane is more volatile than perfluoroheptane, so would be preferred in combination with hydrofluoroether where a greater volatility is desired.

It is believed that samples representative of the entire range of papers used in the United States were included in testing of the hydrofluoroether carrier; papers such as those found in hard cover and soft cover books, encyclopedias, periodicals, newspapers, magazines, comic books and other documents. In addition, tests were run on a variety of bindings including backrams, leathers, synthetic leathers and polymers.

While any suitable known surfactant may be used, it is important that the surfactant not cause damage or leave any telltale odor. It must also be soluble in hydrofluoroether. A preferred surfactant is perfluoropolyoxyether alkanoic acid. In prior carrier media, the surfactant is important for the proper dispersion of the alkaline particles throughout the carrier. It was soon discovered, however, that when hydrofluoroether is used as the dispersant for the alkaline particle, a better dispersion is achieved with much less surfactant than is used in the prior systems. Tests were done to compare the settling times for dispersions wherein perfluorinated carriers or hydrofluoroether carriers were used. The values set forth in the Table were obtained by measurements using a light transmission method. The values are reported in Nephelometric Turbidity Units (NTU). As the NTU value drops, more light is transmitted through the sample, meaning that more of the dispersed phase, in this case alkaline particles, have settled out of the dispersion. Settling rate is directly correlated to the average particle size in the dispersion. The perfluorinated carrier tested was perfluoroheptane, identified as PF5070 in the Table. The hydrofluoroether tested was nonafluoromethoxybutane, identified as HFE7100 in the Table. The surfactant used in the testing was perfluoropolyoxyether alkanoic acid (Fomblin® monoacid). The results are set forth in Table 1.

TABLE 1

DISPERSION STUDIES

| NTU | Elapsed Minutes | DROP | CUMUL | % LOSS | | | |
|---|---|---|---|---|---|---|---|
| HFE 7100 MgO .4 g/l Surfactant .1 g/l | | | | | | | |
| 1196 | 0 | 0 | 0 | 0 | Regression Output: | | |
| 1122 | 15 | 74 | 74 | 6.187291 | Constant | | 3.082244 |
| 1046 | 30 | 76 | 150 | 12.54181 | Std Error Y Est | | 2.1224 |
| 1071 | 45 | −25 | 125 | 10.45151 | R Squared | | 0.962225 |
| 1001 | 60 | 70 | 195 | 16.30435 | No. of Observations | | 11 |
| 968 | 75 | 33 | 228 | 19.06355 | Degrees of Freedom | | 9 |
| 938 | 90 | 30 | 258 | 21.57191 | | | |
| 890 | 105 | 48 | 306 | 25.58528 | X Coefficient(s) | 0.204267 | |
| 837 | 120 | 53 | 359 | 30.01672 | Std Err of Coef. | 0.013491 | |
| 841 | 135 | −4 | 355 | 29.68227 | | | |
| 825 | 150 | 16 | 371 | 31.02007 | | | |

TABLE 1-continued

DISPERSION STUDIES

| NTU | Elapsed Minutes | DROP | CUMUL | % LOSS | | | |
|---|---|---|---|---|---|---|---|
| PFE 5070 MgO .4 g/l Surfactant .1 g/l | | | | | | | |
| 923 | 0 | 0 | 0 | 0 | Regression Output: | | |
| 816 | 15 | 107 | 107 | 11.59263 | Constant | | 7.199842 |
| 749 | 30 | 67 | 174 | 18.85157 | Std Error Y Est | | 5.258791 |
| 678 | 45 | 71 | 245 | 26.54388 | R Squared | | 0.942268 |
| 576 | 60 | 102 | 347 | 37.5948 | No. of Observations | | 11 |
| 566 | 75 | 10 | 357 | 38.67822 | Degrees of Freedom | | 9 |
| 447 | 90 | 119 | 476 | 51.57096 | | | |
| 421 | 105 | 26 | 502 | 54.38787 | X Coefficient(s) | 0.405135 | |
| 409 | 120 | 12 | 514 | 55.68797 | Std Error Coef. | 0.033427 | |
| 388 | 135 | 21 | 535 | 57.96316 | | | |
| 364 | 150 | 24 | 559 | 60.56338 | | | |
| HFE 7100 MgO .4 g/l Surfactant .075 g/l | | | | | | | |
| 1037 | 0 | 0 | 0 | 0 | Regression Output: | | |
| 981 | 15 | 56 | 56 | 5.400193 | Constant | | 2.945552 |
| 964 | 30 | 17 | 73 | 7.039537 | Std Error Y Est | | 2.01327 |
| 905 | 45 | 59 | 132 | 12.72903 | R Squared | | 0.973994 |
| 863 | 60 | 42 | 174 | 16.77917 | No. of Observations | | 14 |
| 818 | 80 | 45 | 219 | 21.11861 | Degrees of Freedom | | 12 |
| 803 | 95 | 15 | 234 | 22.56509 | | | |
| 769 | 110 | 34 | 268 | 25.84378 | X Coefficient(s) | 0.194234 | |
| 738 | 135 | 31 | 299 | 28.83317 | Std Error Coef | 0.01058 | |
| 687 | 160 | 51 | 350 | 33.75121 | | | |
| 663 | 185 | 24 | 374 | 36.06557 | | | |
| HFE 7100 MgO .4 g/l Surfactant .025 g/l | | | | | | | |
| 911 | 0 | 0 | 0 | 0 | Regression Output: | | |
| 887 | 15 | 24 | 24 | 2.634468 | Constant | | 3.205269 |
| 835 | 30 | 52 | 76 | 8.342481 | Std Error Y Est | | 2.583309 |
| 768 | 45 | 67 | 143 | 15.69704 | R Squared | | 0.963476 |
| 735 | 60 | 33 | 176 | 19.31943 | No. of Observations | | 14 |
| 720 | 75 | 15 | 191 | 20.96597 | Degrees of Freedom | | 12 |
| 717 | 90 | 3 | 194 | 21.29528 | | | |
| 697 | 105 | 20 | 214 | 23.49067 | X Coefficient(s) | 0.20315 | |
| 653 | 120 | 44 | 258 | 28.32053 | Std Error Coef. | 0.011418 | |
| 608 | 135 | 45 | 303 | 33.26015 | | | |
| 601 | 150 | 7 | 310 | 34.02854 | | | |
| 570 | 165 | 31 | 341 | 37.43139 | | | |
| 571 | 180 | −1 | 340 | 37.32162 | | | |
| 546 | 195 | 25 | 365 | 40.06586 | | | |

The data from Table 1 is presented in FIG. 1. From the values shown, it can be seen that the settling rate for hydrofluoroether 7100 (HFE7100) is about half that of the perfluorinated compound tested (PF5070). From Stokes law for the free-settling velocity of spherical particles at low Reynolds Number, this corresponds to a decrease in effective particle size of approximately 50%. In gravitational sedimentation methods, particle size is determined from settling velocity. The equation relating particle size to settling velocity is known as Stokes Law:

$$d_{st} = \sqrt{\frac{18\eta u}{(p_s - p_f)g}}$$

where $d_{st}$ is the Stokes diameter, $\eta$ is viscosity, u is the particle settling velocity under gravity, $p_s$ is the particle density, $p_f$ is the fluid density and g is the acceleration due to gravity. Therefore, Stokes diameter is directly proportional to the square root of the settling velocity and inversely proportional to the difference in particle and fluid density. See, Perry's Chemical Engineering Handbook, 20–7 ($7^{th}$ ed).

It can also be seen from the results in Table 1, that a decrease in the amount of surfactant by a factor of four has no effect on the settling rate of MgO in HFE7100.

As provided in the Kundrot patent, a suitable carrier for a liquid suspension of particles is preferably inert and possesses a high enough vapor pressure to allow its removal from the paper following treatment. The boiling point for the hydrofluoroethers are within the range of 40° C.–100° C. The boiling point for the preferred carrier is 60° C.

An odor test was conducted by fanning books, magazines and other cellulose based material being evaluated after treatment using hydrofluoroether and Fomblin® monoacid as the surfactant and recording the first impression on a scale of 0 to 5, from no odor at all to an overpowering odor. No odor was detected in dry books. Fomblin® monoacid is completely soluble in HFE 7100.

In use, a bath of an inert carrier and its suitable associated surfactant is prepared by adding to the carrier an amount of the appropriate surfactant, preferably $1\times10^{-3}$ wt %. The alkaline particles are then added and dispersed throughout the carrier-surfactant medium.

The amount of surfactant and alkaline material will depend in part on the length of treatment and the amount of deposition desired. The carrier is present in excess amounts, sufficient to immerse the quantity of materials being treated. Generally, however, the concentration of alkaline material will be between about 0.01 and about 0.6 weight percent. A most preferred range for the basic material particles is between about 0.01% and about 0.2%, the preferred range for the surfactant is between about $6.25\times10^{-4}$ and $3.74\times10^{-2}$. The preferred alkaline particles, MgO, are generally present in a dispersion maintained at approximately 0.3–6.0 g/L MgO based on the volume of the carrier.

The suspension of alkaline particles in the hydrofluoroether carrier and surfactant is preferably sprayed onto the pages of a book or other document. Alternatively, the cellulose based materials may be immersed into a bath, and preferably moved as described in U.S. Pat. No. 5,422,147 and in U.S. patent application Ser. No. 08/586,252 filed Jan. 16, 1996, now U.S. Pat. No. 5,770,148, both of which are hereby incorporated herein by reference. The movement is preferably continued for 10–30 minutes at room temperature.

The suspension permeates the fibers of the paper leaving alkaline particles behind when the carrier and surfactant medium are evaporated. The pH of the paper is thereby raised and an alkaline reserve of at least 300 milliequivalents reserve per kilogram of paper typically remains in the fiber of the paper. Paper treated with the improved process of the present invention typically show a pH value ranging from 7.5 to 9.5.

The following example demonstrates that the pH of test strips of paper was raised using the improved process of the present invention.

EXAMPLES

Example 1

Twenty-five percent (25%) rag bond paper having an initial pH of 5.5 and an initial alkaline reserve of 0% was dipped in a dispersion of 0.3 g/l MgO, 0.075 g/l Fomblin® in HFE 7100 for 15 minutes at room temperature. Following drying, the pH of the paper was 9.9 and the alkaline reserve was 1.75% (reported as weight percent calcium carbonate equivalent).

Example 2

Experiment 1 was repeated using a dispersion of 0.6 g/l MgO and 0.15 g/l Fomblin® in HFE 7100. The pH of the paper rose to 9.8 and the alkaline reserve rose to 2.35% (wt % calcium carbonate equivalent).

Example 3

Experiment 1 was repeated using a dispersion of 0.3 g/l MgO, 0.3 g/l ZnO, 0.15 g/l Fomblin® in HFE7100. The treated paper had a pH of 9.4 and an alkaline reserve of 1.65% (wt % calcium carbonate equivalent).

Example 4

Experiment 1 was repeated, dipping the bond paper into a dispersion of 4.0 g/l MgO and 1.2 g/l Fomblin® in HFE 7100. The treated paper had a pH of 9.6 and an alkaline reserve of 1.98% (wt % calcium carbonate equivalent).

Example 5

A dispersion of 4.0 g/l MgO, 1.2 g/l Fomblin® in HFE 7100 was sprayed evenly onto the entire surface of both sides of a standard 8½×11 inch sheet of paper having a pH of 5.5 and an alkaline reserve of zero, at a rate of 90 ml/min. for 2.5 seconds per side. Approximately 7.5 ml dispersion was applied. The treated paper had a pH of 9.5 and an alkaline reserve of 1.6% (wt % calcium carbonate equivalent).

What we claim is:

1. A method of treating a cellulose based material, comprising:

dispersing alkaline particles in an inert medium that includes a carrier and an associated surfactant to form a deacidification medium, the alkaline particles being a basic metal selected from the group consisting of oxides, hydroxides and salts, the carrier consisting essentially of one of a hydrofluoroether or the combination of a perfluorinated compound and a sufficient amount of a hydrofluoroether to increase the dispersion of the alkaline particles relative to a perfluorinated carrier; and applying the medium to the cellulose based material.

2. The method of claim 1, wherein the metal includes a cation selected from the group consisting of magnesium, zinc, sodium, potassium, and calcium.

3. The method of claim 1, wherein the surfactant is soluble in hydrofluoroether.

4. The method of claim 3, wherein the surfactant is perfluoropolyoxyether alkanoic acid.

5. The method of claim 1, wherein the hydrofluoroether is nonafluoromethoxybutane.

6. The method of claim 1, wherein the carrier is inert and possesses a sufficiently high vapor pressure to allow its removal from the material following treatment.

7. The method of claim 3, wherein the surfactant is present in amounts between $6.25\times10^{-4}$ and $3.84\times10^{-2}$ weight percent.

8. The method of claim 1, wherein the alkaline particles are present in amounts between about 0.01 and 0.6 weight percent.

9. A method of deacidifying a cellulose based material, comprising:

applying a dispersion to the cellulose bases material, the dispersion including alkaline particles in an inert medium, the alkaline particles being a basic metal selecte from the group consisting of oxides, hydroxides and salts, the inert medium including a carrier and an associated surface, the carrier consisting essentially of one of a hydrofluoroether or the combination of a perfluorinated compound and a sufficient amount of a hydrofluoroether to increase the dispersion of the alkaline particles relative to a perfluorinated carrier.

10. The method of claim 9, wherein the cation of the metal is selected from the group consisting of magnesium, zinc, sodium, potassium, and calcium.

11. The method of claim 9, wherein the surfactant is soluble in hydrofluoroether.

12. The method of claim 9, wherein the surfactant is perfluoropolyoxyether alkanoic acid.

13. The method of claim 9, wherein said applying is accomplished by spraying.

14. In a method of deacidifying cellulose based materials which includes treating said material with alkaline particles of a basic metal selected from the group consisting of oxides, hydroxides and salts dispersed in a liquid carrier in an amount and for a time sufficient for the particles to pass into the interstices of the cellulose based materials and increase the pH thereof, the improvement comprising:

dispersing the particles in an inert medium comprised of a carrier and an associated surfactant, the carrier consisting of a hydrofluoroether.

15. The improvement of claim 14 wherein the surfactant is perfluoropolyoxyether alkanoic acid.

16. The improvement of claim 14 wherein the surfactant is present in amounts between $6.25\times10^{-4}$ and $3.84\times10^{-2}$ weight percent.

17. The improvement of claim 14 wherein the alkaline particles are present in amounts between about 0.01 and 0.6 weight percent.

* * * * *

UNITED STATES PATENT AND TRADEMARK OFFICE

CERTIFICATE OF CORRECTION

PATENT NO. : 6,080,448
DATED : June 27, 2000
INVENTOR(S) : Leiner et al.

It is certified that error appears in the above-identified patent and that said Letters Patent is hereby corrected as shown below:

Column 6, in the second section titled "Regression Output" and after "No. of Observations", delete "14" and substitute therefor --11--;

Column 6, in the second section titled "Regression Output" and after "Degrees of Freedom", delete "12" and substitute therefor --9--;

In claim 9, line 3, delete "bases" and substitute therefor --based--;

In claim 9, line 6, delete "selecte" and substitute therefor --selected--; and

In claim 9, line 8, delete "surface" and substitute therefor --surfactant--.

Signed and Sealed this

Eighth Day of May, 2001

*Attest:*

Nicholas P. Godici

NICHOLAS P. GODICI

*Attesting Officer*

*Acting Director of the United States Patent and Trademark Office*